US011800311B2

(12) United States Patent
Perechnev

(10) Patent No.: US 11,800,311 B2
(45) Date of Patent: Oct. 24, 2023

(54) METHOD OF REPRODUCING AN AUDIO SIGNAL IN A CAR CABIN VIA A CAR AUDIO SYSTEM

(71) Applicant: ASK Industries GmbH, Niederwinkling (DE)

(72) Inventor: Denis Perechnev, Schwarzach (DE)

(73) Assignee: ASK Industries GmbH, Niederwinkling (DE)

( * ) Notice: Subject to any disclaimer, the term of this patent is extended or adjusted under 35 U.S.C. 154(b) by 61 days.

(21) Appl. No.: 17/626,647

(22) PCT Filed: Jul. 16, 2019

(86) PCT No.: PCT/EP2019/069068
§ 371 (c)(1),
(2) Date: Jan. 12, 2022

(87) PCT Pub. No.: WO2021/008684
PCT Pub. Date: Jan. 21, 2021

(65) Prior Publication Data
US 2022/0295211 A1 Sep. 15, 2022

(51) Int. Cl.
*H04S 7/00* (2006.01)
*H04R 1/22* (2006.01)

(52) U.S. Cl.
CPC ..... *H04S 7/302* (2013.01); *H04R 1/22* (2013.01); *H04R 2499/13* (2013.01)

(58) Field of Classification Search
CPC ..... H04S 7/302; H04S 2400/07; H04R 1/22; H04R 2499/13
See application file for complete search history.

(56) References Cited

U.S. PATENT DOCUMENTS

2015/0264510 A1* 9/2015 Jin ..... H04S 7/30 381/303
2017/0053636 A1* 2/2017 Oswald ..... G10K 11/17873
2019/0045316 A1* 2/2019 Schneider ..... H04S 7/30
2019/0104363 A1* 4/2019 Vautin ..... H04R 3/12
2021/0266691 A1* 8/2021 Winton ..... H04S 7/302
2022/0068253 A1* 3/2022 Pignier ..... G10K 11/17883

FOREIGN PATENT DOCUMENTS

EP 3232688 A1 10/2017
EP 3451696 A1 3/2019
WO 2015085924 A1 6/2015

OTHER PUBLICATIONS

Wu, et al., Y., "Multizone 2D Soundfiled Reproduction Via Spatial Band Stop Filters", 2009 IEEE Workshop on Applications of Signal Processing to Audio and Acoustics, New Paltz, New York, Oct. 18-21, 2009, p. 309-312.
International Search Report & Written Opinion to corresponding PCT Application No. PCT/EP2019/069068 dated Apr. 7, 2020.

* cited by examiner

*Primary Examiner* — Jason R Kurr
(74) *Attorney, Agent, or Firm* — Dinsmore & Shohl LLP

(57) ABSTRACT

A method of reproducing an audio signal in a car cabin via a car audio system, the car audio system being configured to define at least one specific listening zone (LZ1, LZ2) of the audio signal for a specific listener position and a specific non-listening zone (NLZ1, NLZ2) of the audio signal for other listener positions within a car cabin, said car audio system comprising an audio signal source and a plurality of audio output devices associated with the audio signal source.

13 Claims, 4 Drawing Sheets

METHOD OF REPRODUCING AN AUDIO SIGNAL IN A CAR CABIN VIA A CAR AUDIO SYSTEM

CROSS REFERENCE TO RELATED APPLICATIONS

The present specification is a National Phase Entry of International Application No. PCT/EP2019/069068 filed Jul. 16, 2019 and entitled "Method of Reproducing an Audio Signal in a Car Cabin Via a Car Autio System" the entirety of which is incorporated by reference herein.

FIELD

The present specification relates to a method of reproducing an audio signal in a car cabin via a car audio system, the car audio system being configured to define at least one specific listening zone of the audio signal for a specific listener position and at least one specific non-listening zone of the audio signal for other listener positions within a car cabin, said car audio system comprising an audio signal source and a plurality of audio output devices associated with the audio signal source.

BACKGROUND

Car audio systems configured to generate different listening zones, sometimes denoted as bright zones, and complementary non-listening zones, sometimes denoted as dark zones, in a car cabin and respective methods for reproducing an audio signal in a respective listening zone are generally known from prior art.

Respective car audio systems may be configured to define a plurality of spatially separated listening zones in a car cabin. Thereby, the audio signals to be reproduced in each listening zone and thus, presented to a user in each listening zone may be different.

A challenging aspect of generating individual listening zones in a car cabin is oftentimes the acoustic interaction ("crosstalk") between respective listening zones in a particular frequency range which may compromise the acoustic distinctiveness and separation, respectively of respective listening zones. In other words, limiting a sound signal designated for a specific listening zones to that specific listening zones and preventing "crosstalk" with an adjacent listening zone may be challenging.

SUMMARY

It is the objective of the present specification to provide an improved method of reproducing an audio signal in a car cabin via a car audio system.

This object is achieved by a method of reproducing an audio signal in a car cabin via a car audio system according to claim 1. The Claims depending on claim 1 refer to possible embodiments of the method according to claim 1.

A first aspect of the present specification refers to a method of reproducing an audio signal in a car cabin via a car audio system. The method thus, allows for reproducing, i.e. particularly outputting, an audio signal in a car cabin via a car audio system. The car audio system operable or operated in accordance with the method is thus, assignable or assigned to a car having a car cabin. The car cabin typically, defines a multi-dimensional acoustically coherent sound space.

The car audio system operable or operated in accordance with the method typically, comprises an audio signal source (audio signal input) and a plurality of audio output devices, i.e. particularly loudspeaker devices, associated with the audio signal source. The plurality of audio output devices is typically, arranged in a specific spatial arrangement relative to each other in the car cabin. As an example, respective audio output devices may be arranged at or in door frames and/or head rests. The arrangement of the plurality of audio output devices is typically, chosen such that at least one specific listening zone of at least one audio signal for a specific listener position and a specific non-listening zone of the audio signal for other listener positions within a respective car cabin can be generated. A respective listening zone and an associated non-listening zone typically, represent complementary sound zones within the acoustic sound space defined by the car cabin.

The car audio system operable or operated in accordance with the method is thus, configured to define and/or generate at least one specific listening zone of at least one audio signal for a specific listener position and at least one specific non-listening zone of the audio signal for other listener positions within a respective car cabin.

As indicated above, a respective listening zone typically, relates to a defined sound zone within the sound space defined by the car cabin, in which the reproduction of an audio signal is acoustically perceivable by a user from a specific position within the respective sound space. A respective listening zone may be deemed or denoted as a bright zone. As indicated above, with respect to a respective listening zone, a respective non-listening zone typically, relates to a complementary sound zone within the sound space in which the reproduction of the respective audio signal is not or significantly less acoustically perceivable by the user from the respective specific position within the respective sound space. A respective non-listening zone may be deemed or denoted as a dark zone.

The car audio system operable or operated in accordance with the method may also be configured to define and/or generate at least two specific listening zones of at least one audio signal for a specific listener position and thus, a plurality of specific non-listening zones of at least one audio signal. Respective listening zones are typically, acoustically and/or spatially separated from each other. Likewise, respective non-listening zones can be acoustically and/or spatially separated from each other.

The steps of the method will be described in the following. The car audio system operable or operated in accordance with the method is thus, configured to perform the following steps of the method:

A first step of the method comprises generating and/or providing at least one specific listening zone of an audio signal for a specific listener position within a car cabin and a specific (complementary) non-listening zone of the audio signal for other listener positions within the car cabin. Hence, in the first step of the method one or more specific listening zone(s) and one or more specific non-listening zone(s) are generated and/or provided in a car cabin. The first step of the method may be performed by a hardware- and/or software embodied listening zone generation device of the car audio system.

A second step of the method comprises assigning an audio signal, which is to be output in the at least one specific listening zone within the car cabin via at least one specific audio output device, to at least one specific audio output device of the car audio system. Hence, in the second step of the method an audio signal is assigned to at least one specific audio output device of the car audio system such that the respective audio signal can be output in the car cabin via the respective audio output device. The second step of the method may be performed by a hardware- and/or software embodied audio signal assignment device of the car audio system.

A third step of the method comprises determining a frequency response of the audio signal path between the audio signal source of the respective audio signal and the respective listening zone within the car cabin. Hence, in the third step of the method a frequency response of the respective audio signal path between an audio signal source and the respective listening zone is determined. The audio signal source is typically, acoustically and/or spatially located in front of the at least one respective audio output device with respect to the acoustic path of the respective audio signal. The third step of the method may comprise using a signal processing step to determine the frequency response of the respective audio signal path between the audio signal source and the respective listening zone. The signal processing step may particularly, allow for determining the acoustic energy level, particularly the decibel (dB) level, in dependency of the frequency in a respective listening zone and a respective non-listening zone. The third step of the method may be performed by a hardware- and/or software-embodied frequency response determining device of the car audio system.

A fourth step of the method comprises determining a specific frequency range of the determined frequency response, the specific frequency range being defined by a first frequency value and a second frequency value of the determined frequency response. Hence, the fourth step of the method comprises selecting a first frequency value and a second frequency value within the determined frequency response, whereby the selected first and second frequency values define a specific frequency range (frequency interval). The selection of the first and second frequency values may be based on a specific selection condition; hence, a respective selection condition may be applied in the fourth step of the method on basis of which the selection of the respective first and second frequency values is performed. A respective selection condition may be that the first and second frequency values are selected in such a manner that the effect of missing fundamental frequencies can be used. The first and second frequency values typically, also define a frequency range in which a bad acoustic separation between at least one listening zone and an associated non-listening zone is given. This may be the case when the difference between the frequency response of the or an audio signal path for a listening zone and the frequency response of the or an audio signal path for an associated non-listening zone reaches or is below a pre-definable or pre-defined threshold value. The first and second frequency values are thus, preferably selected as frequencies for which the effect of missing fundamental frequencies can be used. The fourth step of the method may be performed by a hardware- and/or software-embodied frequency selection device and/or by a hardware- and/or software-embodied frequency range determination device of the car audio system.

A fifth step of the method comprises modifying the determined frequency response in the specific frequency range, whereby a modified frequency response in the specific frequency range is obtained. Hence, in a fifth step of the method the determined frequency response is modified in the specific frequency range such that a modified frequency response is obtained. The fifth step of the method may comprise using a signal processing step to modify the determined frequency response in the specific frequency range such that a modified frequency response in the specific frequency range is obtained. As will be apparent from below, the modification of the determined frequency response in the specific frequency range may comprise applying at least one filter to the determined frequency response in the specific frequency range. The fifth step of the method may be performed by a hardware- and/or software-embodied frequency response modification device of the car audio system.

A sixth step of the method comprises processing the audio signal based on the modified frequency response, whereby the processing includes applying a bass enhancement to the processed audio signal in the specific frequency range. Hence, the sixth step of the method comprises signal processing of the audio signal, whereby a bass enhancement is applied to the processed audio signal in the specific frequency range. The application of the bass enhancement results in an (psycho)acoustically perceivable or perceived increase of the acoustic and/or spatial separation of the at least one listening zone and the at least one associated non-listening zone in the respective frequency range. The bass enhancement typically, comprises increasing the acoustic energy level of the modified frequency response at least with effect for the listening zone in the specific frequency range. The bass enhancement is typically, applied so as to acoustically perceptually fill a gap space in the modified frequency response which gap space was generated by modifying the frequency response of the respective audio signal path in the specific frequency range. The sixth step of the method may be performed by a hardware- and/or software-embodied bass enhancement device of the car audio system. The modification of the frequency response of the respective audio signal path in the specific frequency range may also result in a slight increase of the level of the non-listening zone in the respective frequency range.

A seventh step of the method comprises reproducing (outputting) the processed audio signal with the applied bass enhancement in the car cabin. Hence, in the seventh step of the method, the processed audio signal is reproduced and thus, output in the car cabin. As mentioned above, the application of the bass enhancement results in an (psycho) acoustically perceivable or perceived increase of the separation of the at least one listening zone and the at least one associated non-listening zone in the respective frequency range such that respective undesired "crosstalk" effects are reduced. The seventh step of the method may be performed by at least one audio output device of the car audio system.

The method results in an improvement of the perceived acoustic separation between individual listening zones in a car cabin.

The first and second frequency values may be selected under the premise that the difference of the frequency response of the or an audio signal path for the specific listening zone relative to the frequency response of the or an audio signal path for the specific non-listening zone meets a specific separation condition. Hence, a respective selection condition may be defined under the premise that the difference of the frequency response of the or an audio signal path for a specific listening zone relative to the frequency response of the or an audio signal path for an associated non-listening zone meets a specific separation condition.

The specific separation condition may be met when the difference of the frequency response of the audio signal path for the or a specific listening zone (bright zone) relative to the frequency response of the audio signal path for the or a specific non-listening zone (dark zone) is below a pre-definable or pre-defined threshold value. The threshold value may be a dB-value. The threshold value may particularly, be a dB-value in the range of 3-50 dB, particularly 3-20 dB, preferably equal to or lower than 20 dB. The threshold value may be defined during tuning of the car audio system, for instance.

As indicated above, the modification of the determined frequency response in the specific frequency range may particularly, comprise applying at least one filter to the determined frequency response in the specific frequency range. Particularly, the frequency response of the respective audio signal path in the specific frequency range of may be modified by applying at least one hardware- and/or software-embodied first filter. As an exemplary example, a bandstop filter and/or a band attenuation filter may be used as a first filter.

The method may further comprise applying at least one hardware- and/or software-embodied second filter to the audio signal path in the specific frequency range. As an exemplary example, a bandpass filter may be used as a second filter. The method may thus, generally comprise applying at least two different filters, i.e. particularly a bandstop filter and/or a band attenuation filter and a bandpass filter, to the audio signal in the specific frequency range.

The at least one second filter is typically, applied to the original audio signal coming from the audio signal source. The method may thus, comprise applying (the) at least one second filter to the frequency response in the specific frequency range to the original audio signal coming from audio signal source.

The at least one second filter may be chosen so as to match the characteristics of the first filter. The operating frequency range of the at least one second filter may thus, be adapted to the operating frequency range of the at least one first filter. The at least one first filter and the at least one second filter may thus, operate in the same frequency range.

The method may comprise applying the bass enhancement after applying the at least one first filter and/or the at least one second filter. Hence, the bass enhancement may be applied after applying the at least one first filter and/or after applying the at least one second filter. Particularly, the bass enhancement is applied after the second filter. Applying the bass enhancement after applying the applying the at least one first filter and/or the at least one second filter may increase the effect of the bass enhancement. After applying the at least one first and second filter, the outputs of the at least one first and second filters are typically mixed together, particularly while processing the audio signal.

The output of the at least one second filter may particularly, be mixed with the output of the at least one first filter after generated harmonic components are applied or added to the output of the at least one first filter and/or to the at least one second filter. It is specifically possible that the output of the at least one second filter may be mixed with the output of the at least one first filter after generated harmonic components have been applied or added to the output or were replacing the output of the at least one second filter.

Generally, the expression "output of the at least one first filter" may be understood as direct or indirect output of the at least one first filter. Likewise, the expression "output of the at least one second filter" may be understood as direct or indirect output of the at least one second filter.

The method may further comprise generating harmonic components of the audio signal while processing it by using modified frequency response of the audio signal path and applying the generated harmonic components to the audio signal while processing it by using modified frequency response of the audio signal path in the specific frequency range before reproducing same in the car cabin. Respective harmonic components may be particularly, applied to the output of the at least one first filter and/or to the output of the at least one second filter. Applying respective harmonic components in the specific frequency range may also contribute to the (psycho)acoustically perceivable or perceived increase of the separation of the at least one listening zone and the at least one associated non-listening zone in the respective frequency range. The harmonic components may be generated and applied via a hardware- and/or software embodied harmonic components generating device.

The output of the at least one second filter may particularly, be mixed with the output of the at least one first filter after generated harmonic components have been applied or added to the output of the at least one second filter. The output of the at least one second filter may particularly, be mixed with the output of the at least one first filter after generated harmonic components are applied or added to the output of the at least one second filter. In other words, an indirect output or a modified output of the at least one second filter can be mixed with the output of the at least one first filter.

Thereby, the amount of harmonics generated may be proportional to the attenuation by the at least one first filter. Using an amount of harmonics proportional to the attenuation by the at least one first may also contribute to the (psycho)acoustically perceivable or perceived increase of the separation of the at least one listening zone and the at least one associated non-listening zone in the respective frequency range.

A second aspect of the present specification refers to a car audio system, comprising an audio signal source, a plurality of audio output devices associated with the audio signal source, and a control unit being configured to perform the method of the first aspect of the present specification. The control unit is particularly, configured to generate a specific listening zone of the audio signal for a specific listener position within a car cabin and a specific non-listening zone of the audio signal for other listener positions within the car cabin; assign an audio signal, which is to be output in the specific listening zone within the car cabin via at least one specific audio output device, to at least one specific audio output device of a car audio system; determine a frequency response of the or an audio signal path between the audio signal source of the respective audio signal to the respective listening zone within the car cabin; determine a specific frequency range of the determined frequency response, the specific frequency range being defined by a first frequency value and a second frequency value of the determined frequency response; modify the determined frequency response in the specific frequency range, whereby a modified frequency response in the specific frequency range is obtained; process the audio signal based on the modified frequency response, whereby the processing includes applying a bass enhancement to the processed audio signal in the specific frequency range; and reproduce the processed audio signal with the applied bass enhancement in the car cabin. All annotations regarding the method of the first aspect of the present specification apply in analogous manner and vice versa.

The car audio system may be configured to define a plurality of spatially separated listening zones in a car cabin. Thereby, the audio signals to be reproduced in each listening zone and thus, presented to a user in each listening zone may be different. Different audio signals may refer to different audio information, e.g. different musical pieces, and/or different sound settings, e.g. different treble, bass, etc., for different sound zones. Notably, an audio signal to be reproduced in a specific listening zone may also be zero to generate a silent listening zone.

A third aspect of the present specification refers to a car, comprising an audio signal processing device according to the second aspect of the present specification. All annotations regarding the method of the first aspect of the present specification and the car audio system of the second aspect of the present specification apply in analogous manner and vice versa.

A fourth aspect of the present specification refers to a readable medium, particularly data carrier, comprising machine-readable instructions, that when executed by a processor of a hardware- and/or software-embodied control unit of a car audio system, cause the car audio system to carry out the method according to the first aspect of the present specification. All annotations regarding the method of the first aspect of the present specification apply in analogous manner and vice versa.

BRIEF DESCRIPTION OF THE DRAWINGS

Exemplary embodiments of the present specification are described with reference to the Figures, whereby.

DETAILED DESCRIPTION

Figure 1:
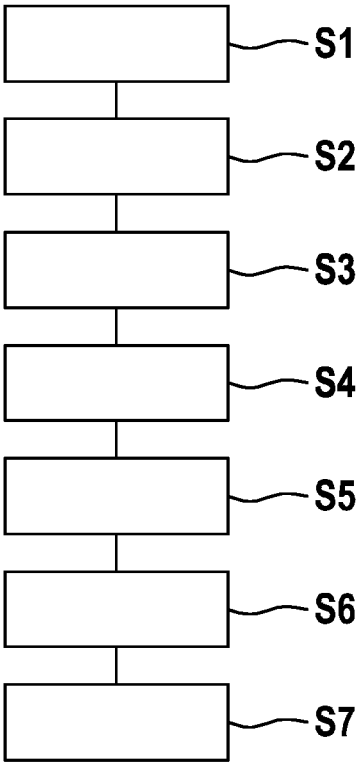
FIG. 1 shows a flow diagram of a method of reproducing an audio signal in a car cabin via a car audio system according to an exemplary embodiment.

FIG. 1 shows a flow diagram of a method of reproducing an audio signal 1 in a car cabin 1 via a car audio system 3 according to an exemplary embodiment.

Figure 5:
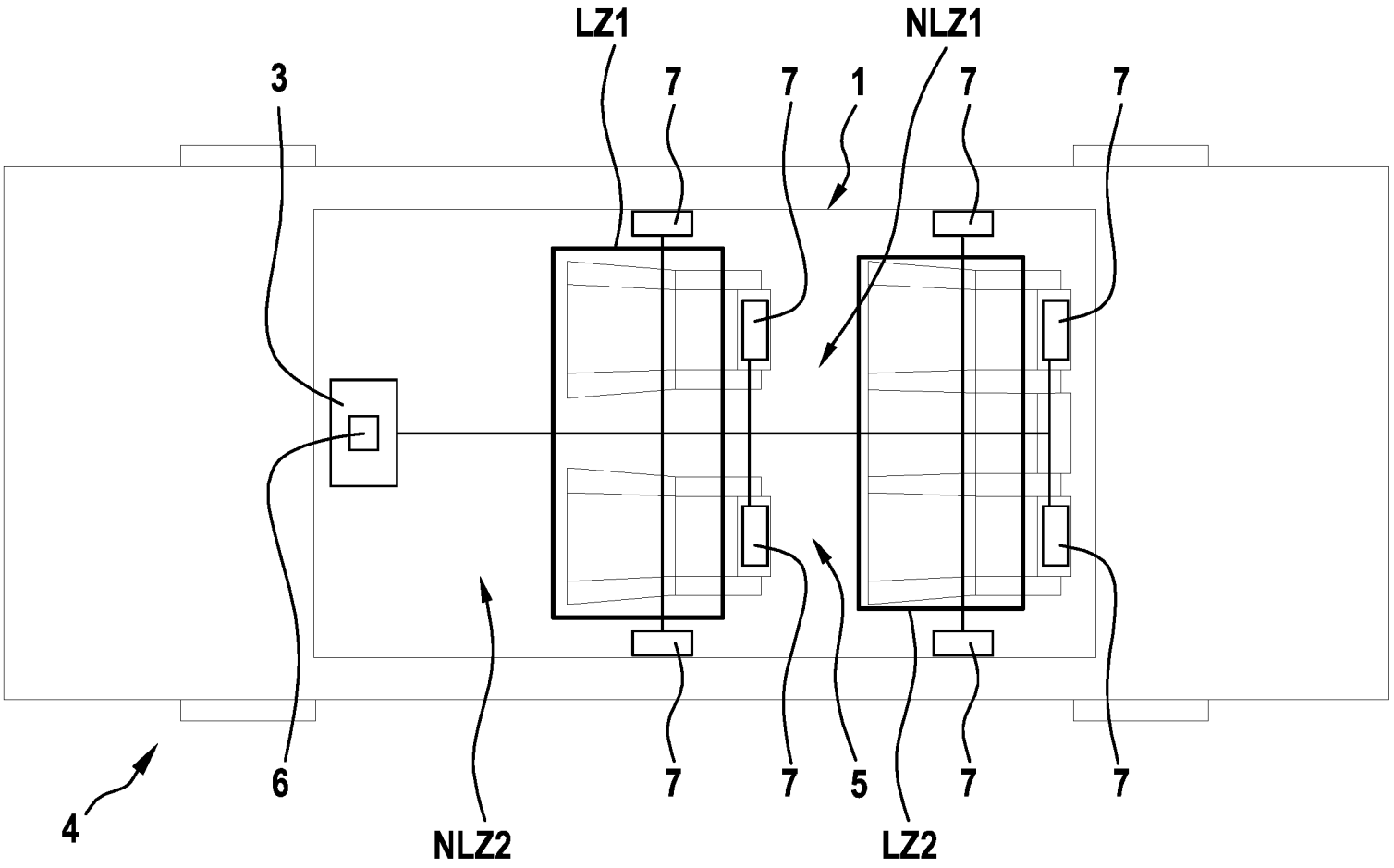
FIG. 5 shows a principle drawing of a car comprising a car audio system according to an exemplary embodiment in a top-view.

The method of FIG. 1 thus, allows for reproducing, i.e. particularly outputting, an audio signal in a car cabin 1 via a car audio system 3 (see FIG. 5). The car audio system 3 operable or operated in accordance with the method is thus, assignable or assigned to a car 4 having a car cabin 1. The car cabin 1 defines a multi-dimensional acoustically coherent sound space 5.

The car audio system 3 operable or operated in accordance with the method comprises an audio signal source 6 (audio signal input) and a plurality of audio output devices 7, i.e. particularly loudspeaker devices, associated with the audio signal source 6. The plurality of audio output devices 7 are arranged in a specific spatial arrangement relative to each other in the car cabin 1. As is apparent from FIG. 5, respective output devices 7 may be arranged at or in door frames and/or head rests of the car 4, for instance. The arrangement of the plurality of audio output devices 7 is chosen such that at least one specific listening zone LZ1, LZ2 of an audio signal for a specific listener position and a specific non-listening zone NLZ1, NLZ2 (indicated by dotted lines) of the or an audio signal for other listener positions within the car cabin 1 can be generated.

The car audio system operable or operated in accordance with the method is thus, configured to define and/or generate at least one specific listening zone LZ1, LZ2 of at least one audio signal for a specific listener position and at least one specific non-listening zone NLZ1, NLZ2 of the audio signal for other listener positions within the car cabin 1.

FIG. 5 exemplarily shows a first listening zone Z1 for at least one user positioned in the front of the car cabin 1 and an associated first non-listening zone NLZ1 as well as a second listening zone Z2 for at least one user positioned in the back of the car cabin 1 and an associated second non-listening zone NLZ2. As is apparent from FIG. 5, respective listening zones LZ1, LZ2 and an associated non-listening zone NLZ1, NLZ2, the non-listening zones NLZ1, NLZ2 represent complementary sound zones with respect to the associated listening zones LZ1, LZ2, and vice versa, within the acoustic sound space 5 defined by the car cabin 1.

As is apparent from FIG. 5, a respective listening zone LZ1, LZ2 relates to a defined sound zone within the sound space 5 defined by the car cabin 1, in which the reproduction of an audio signal is acoustically perceivable by a user from a specific position, e.g. the front or back of the car cabin 1, within the respective sound space 5. A respective listening zone LZ1, LZ2 may be deemed or denoted as a bright zone. As is also apparent from FIG. 5, with respect to a respective listening zone LZ1, LZ2, a respective non-listening zone NLZ1, NLZ2 relates to a complementary sound zone within the sound space 5 in which the reproduction of the respective audio signal is not or significantly less acoustically perceivable by the user from the respective specific position within the respective sound space 5. A respective non-listening zone NLZ1, NLZ2 may be deemed or denoted as a dark zone.

Exemplary steps of the method will be described in the following with reference to the flow diagram of FIG. 1. The car audio system 3 operable or operated in accordance with the method is thus, configured to perform the following steps of the method:

A first step S1 of the method comprises generating and/or providing at least one specific listening zone LZ1, LZ2 of an audio signal for a specific listener position within a car cabin 1 and a specific non-listening zone NLZ1, NLZ2 of the audio signal for other listener positions within the car cabin 1. Hence, in the first step S1 of the method one or more specific listening zone(s) LZ1, LZ2 and one or more specific non-listening zone(s) NLZ1, NLZ2 are generated and/or provided in a car cabin 1. The first step S1 of the method may be performed by a hardware- and/or software embodied listening zone generation device of the car audio system 3.

A second step S2 of the method comprises assigning an audio signal, which is to be output in the at least one specific listening zone LZ1, LZ2 within the car cabin 1 via at least one specific audio output device 7, to at least one specific audio output device 7 of the car audio system 3. Hence, in the second step S2 of the method an audio signal is assigned to at least one specific audio output device 7 of the car audio system 3 such that the respective audio signal can be output in the car cabin 1 via the respective audio output device 7. The second step S2 of the method may be performed by a hardware- and/or software embodied audio signal assignment device of the car audio system 3.

A third step S3 of the method comprises determining a frequency response of the audio signal path between the audio signal source of the respective audio signal and the respective listening zone LZ1 within the car cabin 1. Hence, in the third step S3 of the method a frequency response of the respective audio signal path between an audio signal source 6 and the respective listening zone LZ1, LZ2 is determined. The audio signal source 6 is typically, acoustically and/or spatially located in front of the at least one respective audio output device 7 with respect to the acoustic path of the respective audio signal. The third step S3 of the method may comprise using a signal processing step to determine the frequency response of the respective audio signal path between the audio signal source 6 and the respective listening zone LZ1, LZ2. The signal processing step may particularly, allow for determining the acoustic energy level, particularly the amplitude level or decibel (dB) level, in dependency of the frequency in a respective listening zone LZ1, LZ2 and a respective non-listening zone NLZ1, NLZ2. The third step S3 of the method may be performed by a hardware- and/or software-embodied frequency response determining device of the car audio system 3.

Figure 2:
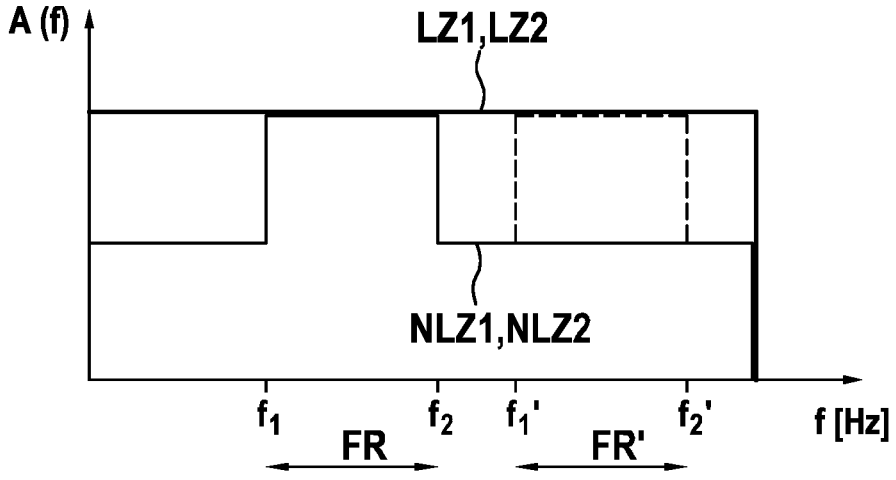
FIG. 2 is a diagram of a frequency response at a stage of the method of FIG. 1.

FIG. 2 is a diagram showing an exemplary frequency response determined in the third step S3 of the method. FIG. 2 particularly shows the acoustic energy level, particularly the amplitude level (y-axis) or decibel (dB) level, in dependency of the frequency (x-axis) in a listening zone, e.g. listening zone LZ1 or LZ2, and an associated non-listening zone, e.g. non-listening zone NLZ1 or NLZ2.

A fourth step S4 of the method comprises determining a specific frequency range FR of the determined frequency response, the specific frequency range FR being defined by a first frequency value f1 and a second frequency value f2 of the determined frequency response. Hence, the fourth step S4 of the method comprises selecting a first frequency value f1 and a second frequency value f2 within the determined frequency response, whereby the selected first and second frequency values f1, f2 define a specific frequency range FR (frequency interval). The selection of the first and second frequency values f1, f2 may be based on a specific selection condition; hence, a respective selection condition may be applied in the fourth step S4 of the method on basis of which the selection of the respective first and second frequency values is performed. A respective selection condition may be that the first and second frequency values f1, f2 are selected in such a manner that the effect of missing fundamental frequencies can be used. The first and second frequency values f1, f2 are thus, preferably selected as frequencies for which the effect of missing fundamental frequencies can be used. As is apparent from FIG. 2, the first and second frequency values f1, f2 typically, also define a frequency range in which a bad acoustic separation between a listening zone LZ1, LZ2 and an associated non-listening zone NLZ1, NLZ2 is given. This may be the case when the difference between the frequency response of an audio signal path for a listening zone LZ1, LZ2 and the frequency response of an audio signal path for an associated non-listening zone NLZ1, NLZ2 reaches or is below a pre-definable or pre-defined threshold value. The fourth step S4 of the method may be performed by a hardware- and/or software-embodied frequency selection device and/or by a hardware- and/or software-embodied frequency range determination device of the car audio system 3.

The first and second frequency values f1, f2 may generally be selected under the premise that the difference of the frequency response of the audio signal path for the specific listening zone LZ1, LZ2 of the audio signal relative to the frequency response of the audio signal path for the specific non-listening zone LZ1, LZ2 of the audio signal meets a specific separation condition. Hence, a respective selection condition may be defined under the premise that the difference of the frequency response of an audio signal path of a specific listening zone LZ1, LZ2 relative to the frequency response of an audio signal path of an associated non-listening zone NLZ1, NLZ2 meets a specific separation condition.

The specific separation condition may be met when the difference of the frequency response of an audio signal path for the specific listening zone LZ1, LZ2 relative to the frequency response of an audio signal path for the associated non-listening zone NLZ1, NLZ2 is below a pre-definable or pre-defined threshold value. The threshold value may be a dB-value. The threshold value may particularly, be a dB-value in the range of 3-50 dB, particularly 3-20 dB, preferably equal to or lower than 20 dB. The threshold value may be defined during tuning of the car audio system 3, for instance.

A fifth step S5 of the method comprises modifying the determined frequency response in the specific frequency range FR, whereby a modified frequency response in the specific frequency range is obtained. Hence, in a fifth step S5 of the method the determined frequency response is modified in the specific frequency range such that a modified frequency response is obtained. The fifth step S5 of the method may comprise using a signal processing step to modify the determined frequency response in the specific frequency range FR such that a modified frequency response in the specific frequency range FR is obtained. As will be apparent from below, the modification of the determined frequency response in the specific frequency range FR comprises applying a first filter to the determined frequency response in the specific frequency range FR. The fifth step S5 of the method may be performed by a hardware- and/or software-embodied frequency response modification device of the car audio system.

Figure 3:
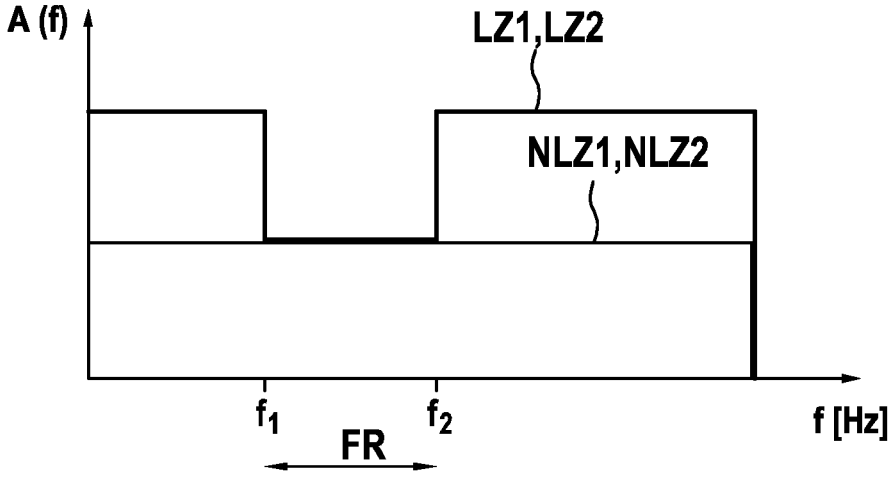
FIG. 3 is a diagram of a frequency response at a stage of the method of FIG. 1.

FIG. 3 is a diagram showing the frequency response after modification in the fifth step S5 of the method. FIG. 3 particularly shows a reduced acoustic energy level, particularly amplitude level (y-axis) or decibel (dB) level, in dependency of the frequency (x-axis) in the listening zone, e.g. listening zone LZ1 or LZ2, and the respective associated non-listening zone, e.g. non-listening zone NLZ1 or NLZ2, which is the result of the modification of the fifth step S5 of the method.

A sixth step S6 of the method comprises processing the audio signal based on the modified frequency response, whereby the processing includes applying a bass enhancement to the processed audio signal in the specific frequency range FR. Hence, the sixth step S6 of the method comprises signal processing of the audio signal, whereby a bass enhancement (indicated by arrow 8 in FIG. 4) is applied to the processed audio signal in the specific frequency range FR. The application of the bass enhancement results in an (psycho)acoustically perceivable or perceived increase of the acoustic and/or spatial separation of the listening zone LZ1, LZ2 and an associated non-listening zone NLZ1, BLZ2 in the respective frequency range FR. The bass enhancement comprises increasing the acoustic energy level at least with effect for the listening zone LZ1, LZ2 in the specific frequency range FR. The sixth step S6 of the method may be performed by a hardware- and/or software-embodied bass enhancement device of the car audio system 3.

Figure 4:
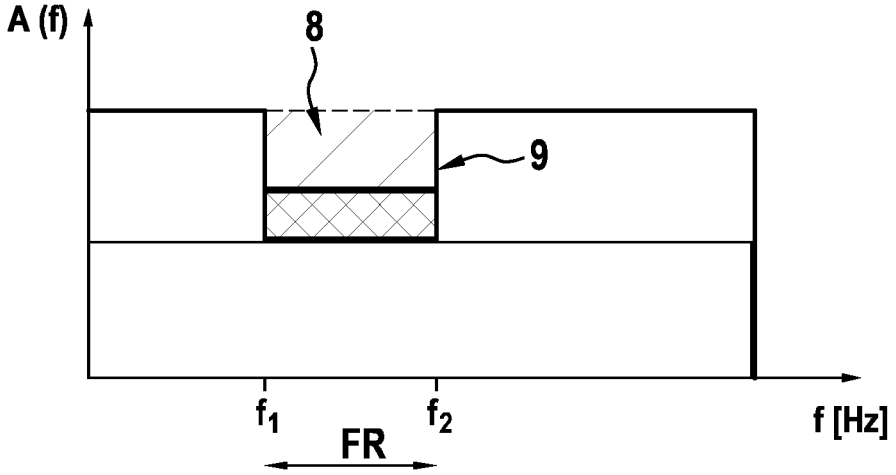
FIG. 4 is a diagram of a frequency response at a stage of the method of FIG. 1.

FIG. 4 is a diagram showing a (psychoacoustically) perceivable or perceived frequency response after modification in accordance with the sixth step S6 of the method. As is apparent from FIG. 4, the bass enhancement is applied so as to acoustically perceptually fill a gap space 9 in the modified frequency response which gap space 9 was generated by modifying the frequency response of the respective audio signal path in the specific frequency range FR. As is indicated by the cross-hatched area in FIG. 4, the modification of the frequency response of the respective audio signal path in the specific frequency range FR may also result in a slight increase of the level of the non-listening zone NLZ1, NLZ2 in the respective frequency range FR.

A seventh step S7 of the method comprises reproducing (outputting) the processed audio signal with the applied bass enhancement in the car cabin 1. Hence, in the seventh step S7 of the method, the processed audio signal is reproduced and thus, output in the car cabin 1. As mentioned above, the application of the bass enhancement results in an (psycho) acoustically perceivable or perceived increase of the separation of the listening zone LZ1, LZ2 and the non-listening zone NLZ1, NLZ2 in the respective frequency range FR such that respective undesired "crosstalk" effects are reduced. The seventh step S7 of the method may be performed by at least one audio output device of the car audio system 3.

The modification of the determined frequency response in the specific frequency range FR may particularly, comprise applying at least one first filter 11 to the determined frequency response in the specific frequency range. As an exemplary example, a bandstop filter and/or a band attenuation filter may be used as a first filter 11.

The method may further comprise applying at least one hardware- and/or software-embodied second filter 12 to the audio signal in the specific frequency range FR. As an exemplary example, a bandpass filter may be used as a second filter 12. The method may thus, generally comprise applying at least two different filters 11, 12, i.e. particularly a bandstop filter and/or a band attenuation filter and a bandpass filter, to the audio signal in the specific frequency range FR.

The second filter 12 is typically, applied to the original audio signal coming from the audio signal source 6. The method may thus, comprise applying (the) at least one second filter 12 to the frequency response in the specific frequency range FR to the original audio signal coming from audio signal source 6.

The second filter 12 may be chosen so as to match the characteristics of the first filter 11. The operating frequency range of the second filter 12 may thus, be adapted to the operating frequency range of the first filter 11. The first filter 11 and the second filter 12 may thus, operate in the same frequency range.

The method may comprise applying the bass enhancement after applying the first filter and/or the second filter 11, 12. Hence, the bass enhancement may be applied after applying the first filter 11 and/or after applying the second filter 12. Particularly, the bass enhancement is applied after the second filter 12. Applying the bass enhancement after applying the applying the first filter 11 and/or the second filter 12 may increase the effect of the bass enhancement. After applying the first and second filter 11, 12, the outputs of the first and second filters 11, 12 are typically mixed together, particularly while processing the audio signal.

The method may further comprise generating harmonic components of the audio signal while processing it by using modified frequency response of the audio signal path and applying the generated harmonic components to the audio signal while processing it by using modified frequency response of the audio signal path in the specific frequency range FR before reproducing same in the car cabin 1. Respective harmonic components may be particularly, applied to the output of the first filter 11 and/or to the output of the second filter 12. Applying respective harmonic components to the modified frequency response of the audio signal path in the specific frequency range FR may also contribute to the (psycho)acoustically perceivable or perceived increase of the separation of a listening zone LZ1, LZ2 and an associated non-listening zone NLZ1, NLZ2 in the respective frequency range FR. The harmonic components may be generated and applied via a hardware- and/or software harmonic components generating device 14.

Thereby, the amount of harmonics generated may be proportional to the attenuation by the first filter 11. Using an amount of harmonics proportional to the attenuation by the first filter 11 may also contribute to the (psycho)acoustically perceivable or perceived increase of the separation of a listening zone LZ1, LZ2 and an associated non-listening zone NLZ1, NLZ2 in the respective frequency range FR.

Figure 6:
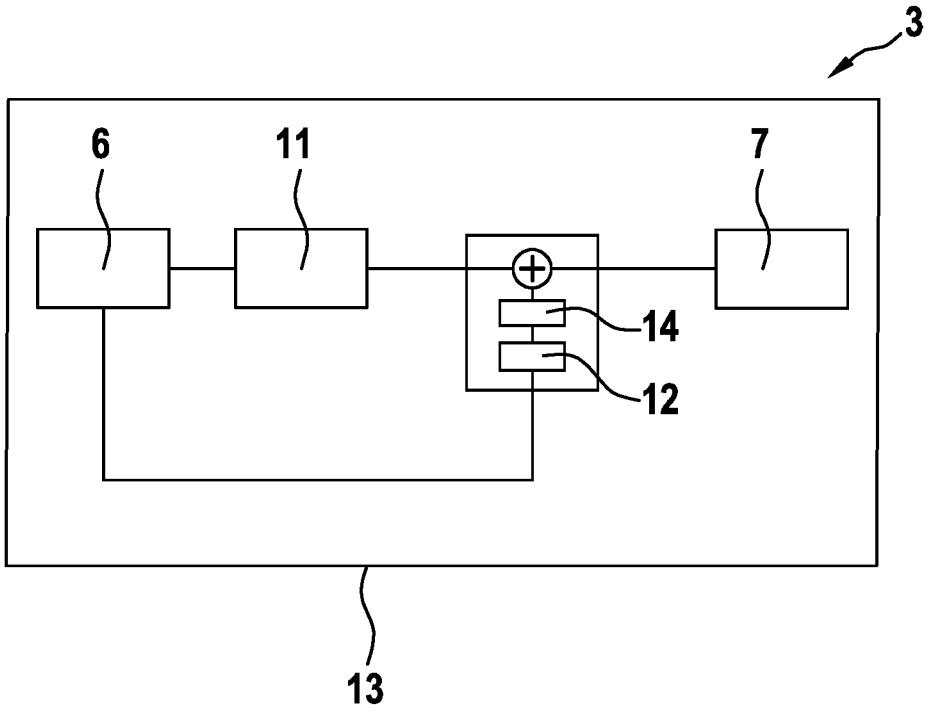
FIG. 6 shows a principle drawing of a car audio system according to an exemplary embodiment.

FIG. 6 shows a principle drawing of a car audio system 3 according to an exemplary embodiment.

As is apparent from FIG. 6, the car audio system 3 comprises an audio signal source 6, a plurality of audio output devices 7 associated with the audio signal source 6, and a hardware- and/or software embodied control unit 13 being configured to perform the method of FIG. 1.

FIG. 6 also shows the logic arrangement of respective first and second filters 11, 12 and the harmonic components generating device 14 which may also form part of the car audio system 3.

The control unit 13 may operate on basis of a machine-readable medium, particularly data carrier, comprising machine-readable instructions, that when executed by a processor of the control unit 13, causes the car audio system 3 to carry out the method of FIG. 1.

FIG. 6 also indicates that the output of the second filter 12 may be mixed with the output of the first filter 11 after harmonic components generated by the harmonic components generating device 14 have been applied or added to the output of the second filter 12. The output of the second filter 12 may thus, particularly, be mixed with the output of the first filter 11 after generated harmonic components are applied or added to the output of the second filter 12. It is specifically possible that the output of the second filter 12 may be mixed with the output of the first filter 11 after generated harmonic components have been applied or added to the output or were replacing the output of the second filter 12.

Generally, the expression "output of the first filter" may be understood as direct or indirect output of the first filter 11 and the expression "output of the second filter" may be understood as direct or indirect output of the second filter 12.

Referring back to FIG. 2, FIG. 2 indicates by dashed lines that there may generally, be multiple frequency ranges FR, FR' defined by respective first and second frequency values f1' and f2' such that the method may also be implemented for multiple frequency ranges FR, FR'.

The invention claimed is:

1. A method of reproducing an audio signal in a car cabin via a car audio system, the car audio system being configured to define at least one specific listening zone of the audio signal for a specific listener position and a specific non-listening zone of the audio signal for other listener positions within a car cabin, said car audio system comprising an audio signal source and a plurality of audio output devices associated with the audio signal source, comprising the steps of:

generating a specific listening zone of the audio signal for a specific listener position within a car cabin and a specific non-listening zone of the audio signal for other listener positions within the car cabin;

assigning an audio signal, which is to be output in the specific listening zone within the car cabin via at least one specific audio output device, to at least one specific audio output device of a car audio system;

determining a frequency response of the audio signal path between the audio signal source of the respective audio signal to the respective listening zone within the car cabin;

determining a specific frequency range of the determined frequency response, the specific frequency range being defined by a first frequency value and a second frequency value of the determined frequency response;

modifying the determined frequency response in the specific frequency range, whereby a modified frequency response in the specific frequency range is obtained;

processing the audio signal based on the modified frequency response, whereby the processing includes applying a bass enhancement to the processed audio signal in the specific frequency range; and reproducing the processed audio signal with the applied bass enhancement in the car cabin, wherein the bass enhancement is applied so as to perceptually fill a gap space in the modified frequency response which gap space was generated by modifying the frequency response of the respective audio signal path in the specific frequency range; and wherein the frequency response of the respective audio signal path in the specific frequency range is modified by applying at least one first filter, particularly a bandstop filter or a band attenuation filter.

2. The method according to claim 1, wherein the first and second frequency values are selected as frequencies for which the effect of missing fundamental frequencies can be used.

3. The method according to claim 1, wherein the first and second frequency values are selected under the premise that the difference of frequency response of the audio signal path for the specific listening zone relative to the frequency response of the audio signal path for the specific non-listening zone meets a specific separation condition.

4. The method according to claim 3, wherein the specific separation condition is met when the difference of frequency response of the audio signal path for the or a specific listening zone relative to the frequency response of the audio signal path for the or a specific non-listening zone is below a pre-definable or pre-defined threshold value.

5. The method according to claim 1, further comprising applying at least one second filter, particularly a bandpass filter, to the audio signal, particularly the audio signal coming from the or an audio signal source, in the specific frequency range.

6. The method according to claim 5, wherein the bass enhancement is applied after applying the at least one second filter.

7. The method according to claim 1, wherein the at least one second filter is chosen so as to match the characteristics of the first filter.

8. The method according to claim 1, wherein after applying the at least one first and second filters, the outputs of the first and second filter are mixed together, particularly while processing the audio signal.

9. The method according to claim 1, further comprising generating harmonic components of the audio signal while processing it by using modified frequency response of the audio signal path and applying the generated harmonic components to the audio signal while processing it by using modified frequency response of the audio signal path in the specific frequency range before outputting same in the car cabin.

10. The method according to claim 9, wherein the amount of harmonics generated is proportional to the attenuation by the at least one first filter.

11. A car audio system, comprising an audio signal source and a plurality of audio output devices associated with the audio signal source, and a control unit being configured to carry out the method of claim 1.

12. A car, comprising a car audio system according to claim 11.

13. A non-transitory machine-readable medium, particularly data carrier, comprising machine-readable instructions, that when executed by a processor of a hardware- and/or software-embodied control unit of a car audio system, cause the car audio system to carry out the method according to claim 1.

* * * * *